United States Patent [19]

Goldish

[11] Patent Number: 4,896,659

[45] Date of Patent: Jan. 30, 1990

[54] GRAVITY LUMBAR TRACTION DEVICE

[75] Inventor: Gary D. Goldish, Golden Valley, Minn.

[73] Assignee: Regents of the University of Minnesota, Minneapolis, Minn.

[21] Appl. No.: 91,845

[22] Filed: Sep. 1, 1987

Related U.S. Application Data

[63] Continuation-in-part of Ser. No. 922,665, Oct. 24, 1986, abandoned.

[51] Int. Cl.[4] ..... A61H 1/02

[52] U.S. Cl. ..... 128/75; 128/78

[58] Field of Search ..... 128/75, 78, 84 B, 84 R, 128/84 C; 272/112, 120, 121, 119, 139, 143, DIG. 903, 116, 117, 118

[56] References Cited

U.S. PATENT DOCUMENTS

| | | | |
|---|---|---|---|
| 864,188 | 8/1907 | Patterson | 272/120 |
| 2,984,238 | 5/1961 | Axtell | 123/75 |
| 3,118,441 | 1/1964 | George | 128/32 |
| 3,353,532 | 11/1967 | Ellis | 128/75 |
| 3,896,798 | 7/1975 | Simon | 128/75 |
| 4,205,665 | 6/1980 | Burton | 128/68 |
| 4,269,179 | 5/1981 | Burton et al. | 128/75 |
| 4,372,552 | 2/1983 | Carlmark | 272/112 |
| 4,396,012 | 8/1983 | Cobiski | 128/75 |
| 4,422,452 | 12/1983 | Burton | 128/75 |
| 4,524,763 | 7/1985 | Eberling, Jr. | 128/75 |
| 4,569,340 | 2/1986 | Burton | 128/75 |
| 4,608,969 | 9/1986 | Hamlin | 128/71 |
| 4,632,099 | 12/1986 | Mollo | 128/75 |

FOREIGN PATENT DOCUMENTS

| | | | |
|---|---|---|---|
| 209952 | 5/1957 | Australia | 128/75 |
| 3420858 | 12/1985 | Fed. Rep. of Germany | 128/75 |
| 7704344 | 10/1978 | Netherlands | 128/75 |
| 220557 | 10/1967 | Sweden . | |
| 1284541 | 1/1987 | U.S.S.R. | 128/75 |

OTHER PUBLICATIONS

C. A. Troucillier's device (1924), FIG. 23.

"The Use of Traction in Bachache," E. H. Frazer, *The Medical Journal of Australia,* 10/30/54, pp. 694–697.

"A Device for the Application of Heavy Lumbar Traction: Its Mechanical Effects," J. F. Lehmann, G. D. Brunner, *Archives of Physical Medicine & Rehabilitation,* 11/58, pp. 696–700.

*Primary Examiner*—William Pieprz
*Assistant Examiner*—Huong Q. Pham
*Attorney, Agent, or Firm*—Kinney & Lange

[57] ABSTRACT

A support that uses gravity and the patient's own body weight to produce traction for lumbar reduction is in the form of a vest worn around the patient's chest and including weight supporting arm rests attached to the vest, so the elbows and forearms can be rested thereon to partially support the patient's weight. The weight supported through the arms relieves part of the load on the ribs and trunk of the patient. The support is low cost and comprises a cross bar such as the commonly used chinning bar that is supported in a doorway at a height adjusted so the patient can touch the floor with his toes and adjust the weight supported through the vest, as well.

16 Claims, 5 Drawing Sheets

GRAVITY LUMBAR TRACTION DEVICE

The application is a continuation-in-part application of my co-pending application Ser. No. 922,665 filed Oct. 24, 1986, for an Upright Gravity Lumbar Traction Device.

BACKGROUND OF THE INVENTION

1. Field of the Invention

The present invention relates to patient supports for providing gravity traction to the lumbar spine.

2. Description of the Prior Art

The advantages of gravity induced lumbar reduction have been recognized, and such treatment has been advanced by Dr. Charles V. Burton, the inventor of U.S. Pat. No. 4,205,665, issued July 3, 1980; U.S. Pat. No. 4,269,179, issued May 26, 1981; and U.S. Pat. No. 4,422,452, issued Dec. 27, 1983. The basis concept of gravity lumbar reduction is the use of gravity and the patient's own body weight to produce traction. Traction in gravity lumbar reduction, as shown in the above-mentioned patents, is provided by hanging the patient on a tilt table through suspension straps attached to a vest worn around the patient's chest. The tilt table framework permits varying the force of traction by varying the inclination of the table and the patient. When the patient is upright, the maximum traction is provided on the lumbar spine. The tilt table requires a supporting framework and is cumbersome, large, and fairly expensive to make. Additionally, the vests for supporting the patient, which are shown in U.S. Pat. Nos. 4,269,179 and 4,422,452 engage the patient's rib cage, and are designed to support a patient only through the vest engaging the rib cage.

U.S. Pat. No. 4,269,179 illustrates a vest on a patient that is resting on a tilt table in the form of an inclined board suspended from a metal frame. The inclination of the board is used for controlling the force of traction on the patient and thus a special board and board support are required. U.S. Pat. No. 4,269,179 also shows a flexible or non-rigid vest material that is designed to provide a conforming fit around the patient's torso. The vest is supposed to conform to the contour of the patient's rib cage for increased comfort.

U.S. Pat. No. 4,422,452 relates to a traction vest that has a flexible and cushioned insert that acts directly against the torso of a patient.

Additional developments in relation to traction apparatus of this general type are shown in U.S. Pat. Nos. 4,524,763, issued June 25, 1985, which utilizes an inclined support board and a vest that goes around the torso of a patient. The board is made on a frame that can be folded.

A vertical traction support belt is shown in U.S. Pat. No. 4,396,012, issued Aug. 2, 1983. The belt has a synthetic rubber material on the inside. The belt fastens around the torso of the patient to support the patient in much the same manner as that disclosed in the previous mentioned Burton patents.

A therapeutic traction apparatus that provides for supporting a patient on horizontal bars is shown in U.S. Pat. No. 3,896,798.

In each of the vest type and belt type prior art devices, the most frequent adverse affect is chest discomfort which translates into contraction of the trunk muscles that invariably counteracts the force of gravity. Gravity lumbar reduction is also difficult to carry out for those patients with any respiratory illness since the support vests act only through the chest. Even in patients that are in general good health, chest compression limits the angle of the tilt table and thus the traction force that can be tolerated. Additionally, the costs involved in present upright gravity lumbar traction systems are substantial. The vests tilt tables add considerable expense and make it quite cumbersome. This limits the use of the apparatus.

SUMMARY OF THE INVENTION

The present invention relates to a vest for providing upright gravity lumbar traction comprising an outer shell portion that engages the thorax of the patient to support weight as needed. Attached on lateral sides of the vest are arm rests comprising elongated gutters on which the elbows and forearms of the patient can be placed to partially carry the patient's body weight when the vest is suspended. The outer shell of the vest is made so that weight can be transferred from the upper extremities to the vest and through the vest's supporting straps and connections. Preferably, the outer shell is made of a light semi-rigid material, such as polypropylene, which can be molded to generally follow the contour of the patient's thorax. By following the general contour of the patient's body, a greater portion of the vest contacts the patient's skin, spreading the weight out and decreasing pressure concentration, making treatment more tolerable. The outer shell can be made open across the chest of the patient to allow the chest to expand anteriorly and so as not to constrict the diaphragm.

The vest in used in connection with a conventional cross bar or chin bar that is supported in a door frame at a desired level. The vest supporting connection comprises shoulder straps that are fixed to the front and rear sides of the vest shell, and in one form, to the arm rests. The straps are supported on the chin bar in a desired manner which can be adjusted in length if desired so that the patient is supported at a level allowing the patient's toes to touch the floor to partially support the patient's body weight.

A board may be placed between the patient and the door frame at the patient's back or front to vary the angle of support for better positioning of the spine. Tilting is not needed as with a tilt board, since the patient merely pushes his/her toes to the floor and thus varies the traction force. Additionally, by distributing the patient's weight through the arm rests or supports, the patient's entire weight does not have to be supported through the vest, thereby increasing comfort and permitting the patient to more easily tolerate the treatment. At the same time, there is better relaxation of the trunk muscles because the forces of gravitational traction can be varied by the patient.

The ability to support weight on the feet permits complete interruption of the traction forces and thus permits intermittent traction loads (cycling on and off at desired intervals). The device also permits adding weight to the ankles or pelvis to increase traction forces because the body weight can be distributed across larger skin areas and greater force can be tolerated by the patient.

The entire unit is compact, even including the cross bar or chin up bar, and this makes it much easier to use in a home as well.

DETAILED DESCRIPTION OF THE PREFERRED EMBODIMENTS

Figure 1:
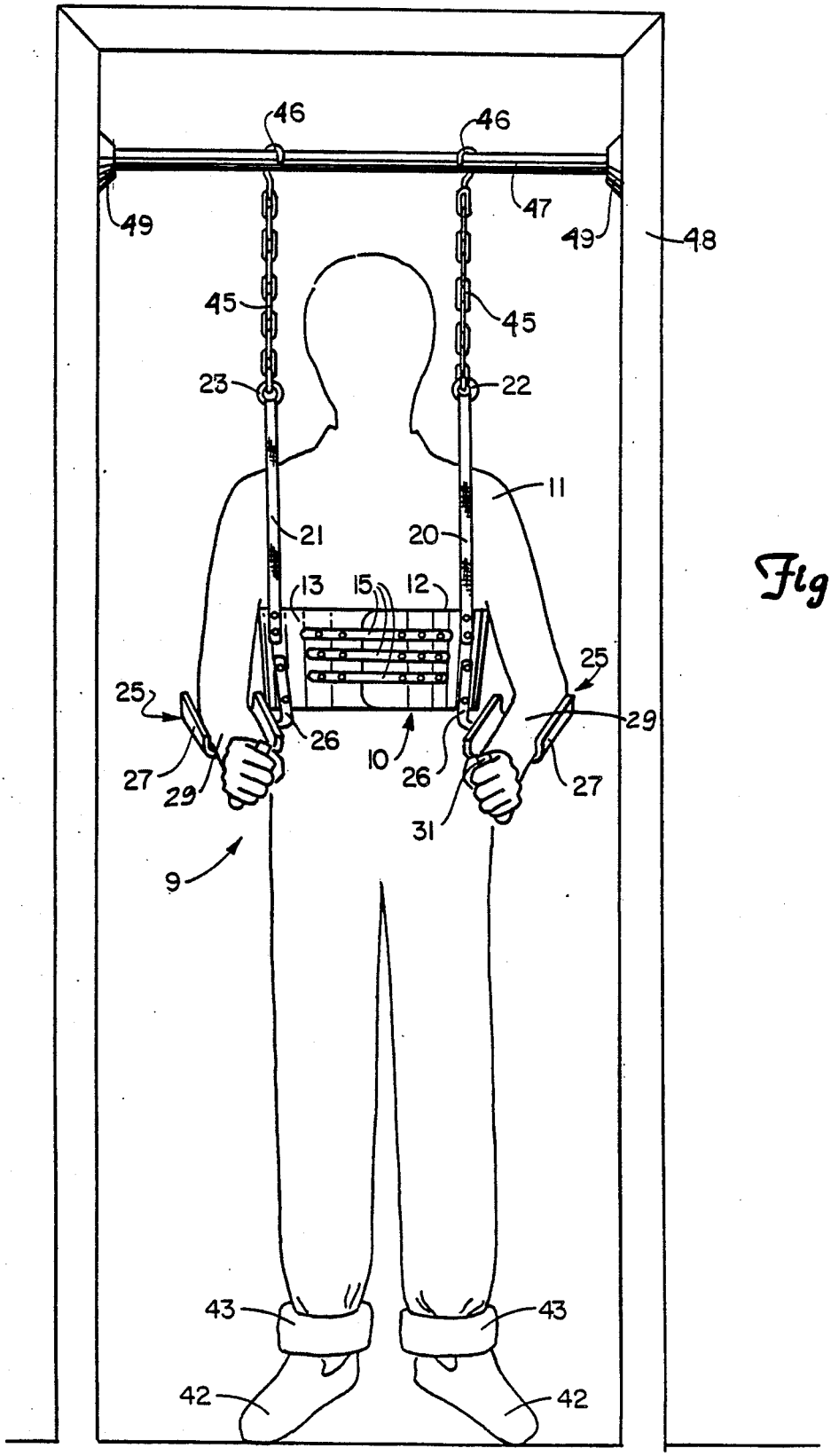
FIG. 1 is a front elevational view of a gravity lumbar traction device made according to a first form of the present invention.

The upright gravity lumbar traction device made according to a first form of the present invention indicated generally at 9 is shown being worn by a patient or user 11 that is receiving treatment for disorders of the lumbar spine. The apparatus 9 comprises a hard shelled or rigid vest 10, which as shown is made into two shell exterior vest sections 12 and 13, that fit around the sides of the body near the lower portions of the rib cage. A suitable foam liner 14 can be provided on the inside surfaces of the exterior vest sections 12 and 13. The vest sections, as shown in the first form can overlap at the front and rear and telescope slightly to adjust for different size torsos. The vest sections preferably are of semi-rigid or relatively inflexible material such as molded polypropylene.

The two vest sections 12 and 13 are fastened together with a plurality of straps or other fasteners shown at 15 that are adjustable as to length. The fasteners 15 are positioned at both the front and back of the vest sections 12 and 13.

Shoulder support straps indicated generally at 20 and 21 are attached to the vest sections 12 and 13, respectively, at both the front and back of each vest section, and support rings 22 and 23 are provided on the straps 20 and 21. The support straps can be attached to other positions on the vest if desired, as well.

Each of the vest sections 12 and 13 is provided with an arm rest or support indicated generally at 25. The arm rests 25 comprise concave troughs 27 which are fixed on suitable brackets 26 that in turn are fixed to the hard shell vest sections 12 and 13, respectively. The brackets 26 are bolted to the respective vest sections using a set of adjustment holes 28 provided in the vest sections. The troughs 27 are positioned at a level so that when the vest 10 is being worn by a patient, they will comfortably fit under and support the forearm 29 of the patient 11, when the patient's arm is bent at the elbow. The troughs 27 are elongated and are generally perpendicular to the body axis of the patient. In other words, the patient can place his forearms into the support troughs 27 and partially support his weight through the upper arms and shoulders. The vest 10 does have to be made so the loads can be transferred from the arms to the vest. Thus, the vest sections must be load-supporting for the arm rests 25.

As shown, forwardly extending optional frame members 30 are fixed to the troughs. Optional hand grips 31 are mounted in upright extending portions of the frame members 30. The hand grips 31 are positioned forwardly from the vest and a patient can grip them as shown in FIG. 1 to increase the ability to support one's weight at least partially through the forearm muscles and the grips to partially relieve the weight supported by the ribs through the loop type vest 10.

Figure 2:
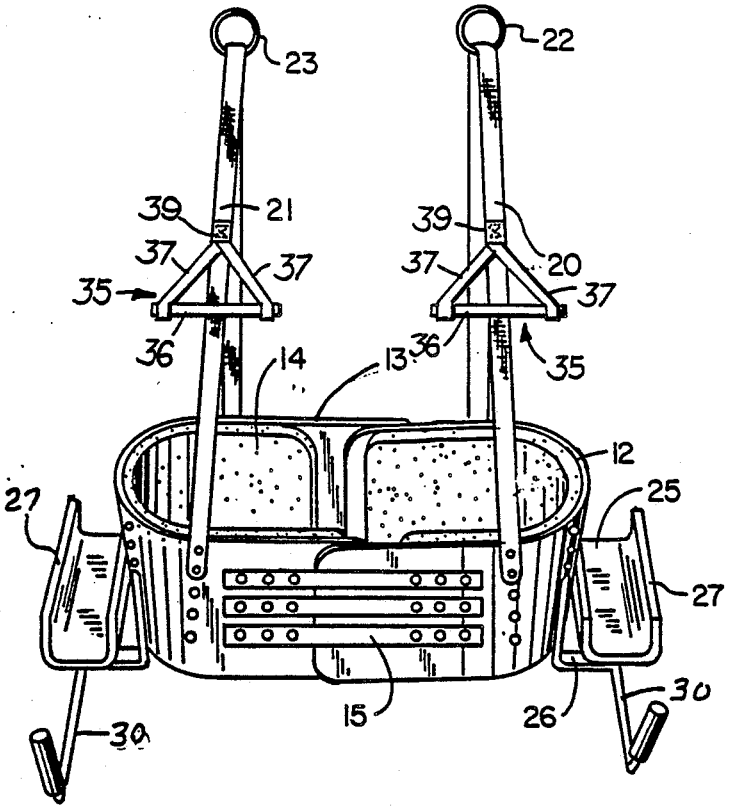
FIG. 2 is a front perspective elevational view of the vest shown in FIG. 1.
Figure 3:
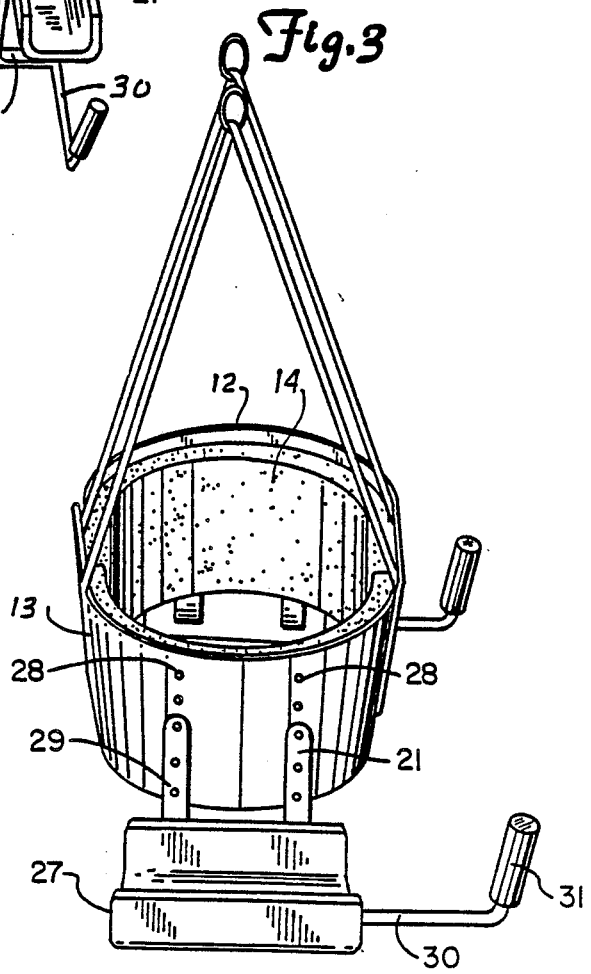
FIG. 3 is a side perspective view of the vest of FIG. 2.

Hand grips or handles can also be supported on the front section of straps 20 and 21 so a patient can reach up and lift the upper body up from the vest to relieve forces on the ribs by using the arms and shoulders. This can be done with the elbows supported on the arm rests, or independently of the arm rests. This variation is shown in FIG. 2 where handles 35 comprising short hand grips or bars 36 are supported on a pair of straps 37 (one on each of the hand grips). The straps 37 taper together and are supported on the front portion of strap 20 and 21 by stitching, rivets or similar fasteners at 39.

When a patient is supporting his weight through the upper arms and the shoulders, relaxation of the trunk muscles is more likely and thus the gravity lumbar treatment is more effective.

As shown, the adjustment openings 28 on the vest sections can be at any selected height so that suitable fasteners 29 can be used for moving the supports 26 up or down. These adjustments could also be held in slotted openings in the vest sections. Also, the frame members 30 can be mounted for adjustment along their longitudinal axes.

The rings 22 and 23, on the shoulder straps 20 and 21, are in turn attached to support chains 45, which have hooks 46 on the upper ends thereof that are of size to fit over a chin up or cross bar 47 supported onto a door frame 48 with suitable support members 49. The chin up bar 47 is a standard bar that is used extensively, and is supported on door frames using supports such as those shown at 49, in a conventional manner. The support bars suspended from the ceiling or even ceiling hooks can be used. The chains 45 are adjusted in relation to the height of the chin up bar 47 so that the patient's feet 42 can be moved so the toes touch the floor when the toes are tilted down. The weight of the patient that is supported through the vest, including the support through the arm support members 25, can then be varied or relieved fully by the patient by supporting part of the body weight (or his entire weight) on the floor. Adjustment of height is easy because conventional chains 45 can be adjusted by moving the hooks 46 to different links without any difficulty, utilizing the link lengths for adjustment.

The ability for the patient to support his full weight permits either continuous traction loading for an extended period at full weight or partial weight loading. Further intermittent traction (two minutes load and two minutes no-load, for example) is possible. If desired, weights, such as those shown in dotted lines at 43, may be added to the ankles of a patient by strapping them in place.

The support vest 10 is quite cost efficient because the preferred hard plastic shell can be easily molded, and the interior padding does not have to be as complex or as expensive as that where the ribs alone provide support for the patient's weight and the padding can be eliminated. The vest of the present invention distributes the traction forces over more surface area, in that the forearms resting in the troughs 27 (which also can be padded) relieve pressure on the ribs and allow better relaxation of the trunk muscles. When there is greater surface area that is supporting the weight of the patient, the less that any one area of the body suffers.

There is no need for varying the angle of support using a tilt table, because the patient can simply push his toes to the floor to vary the forces of traction.

Intermittent traction supporting the weight fully for selected periods between traction permits various treatment cycles and can be used to avoid excessive discomfort.

Figure 4:
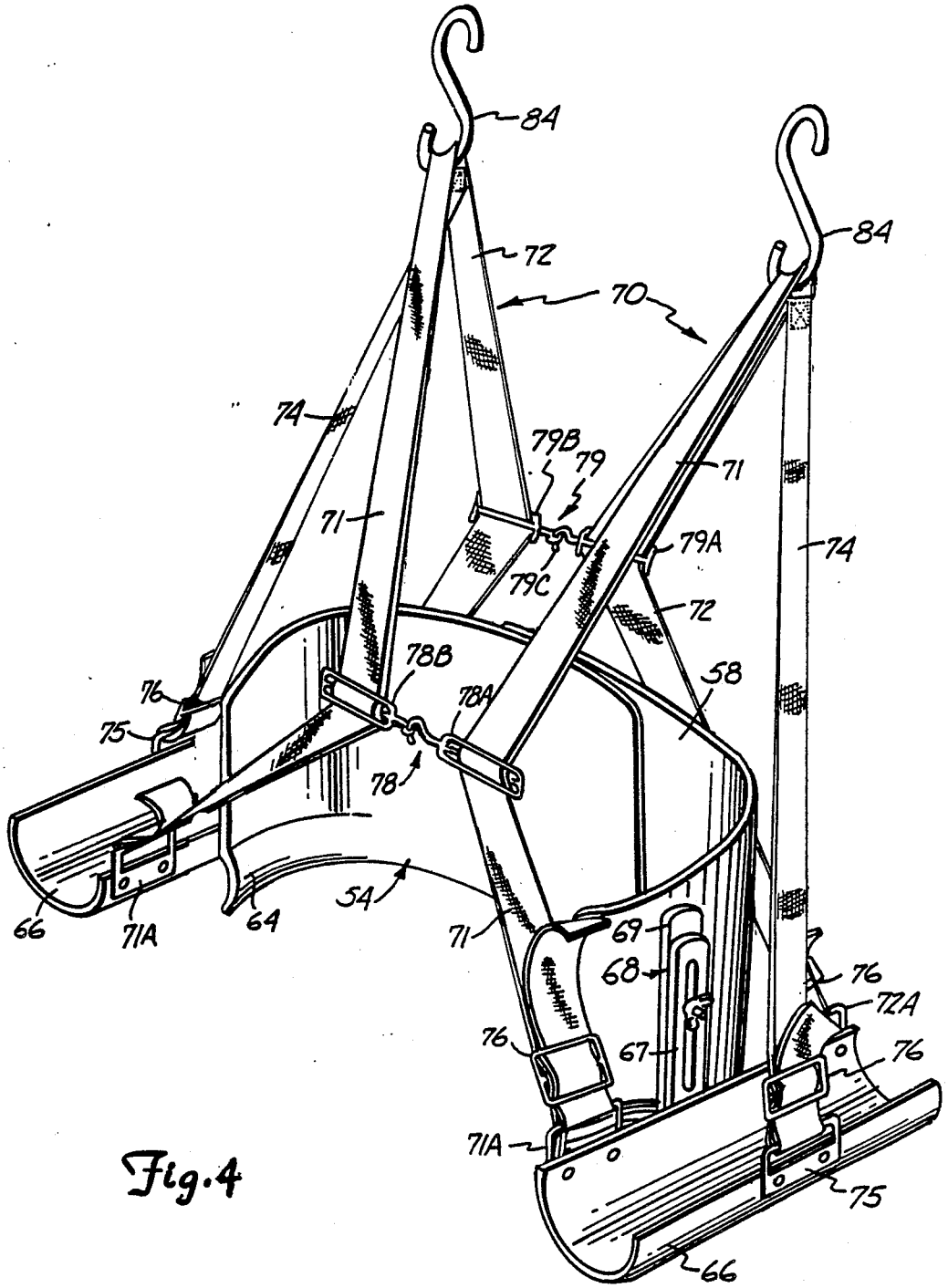
FIG. 4 is a perspective view of a preferred second embodiment of the present invention.
Figure 5:
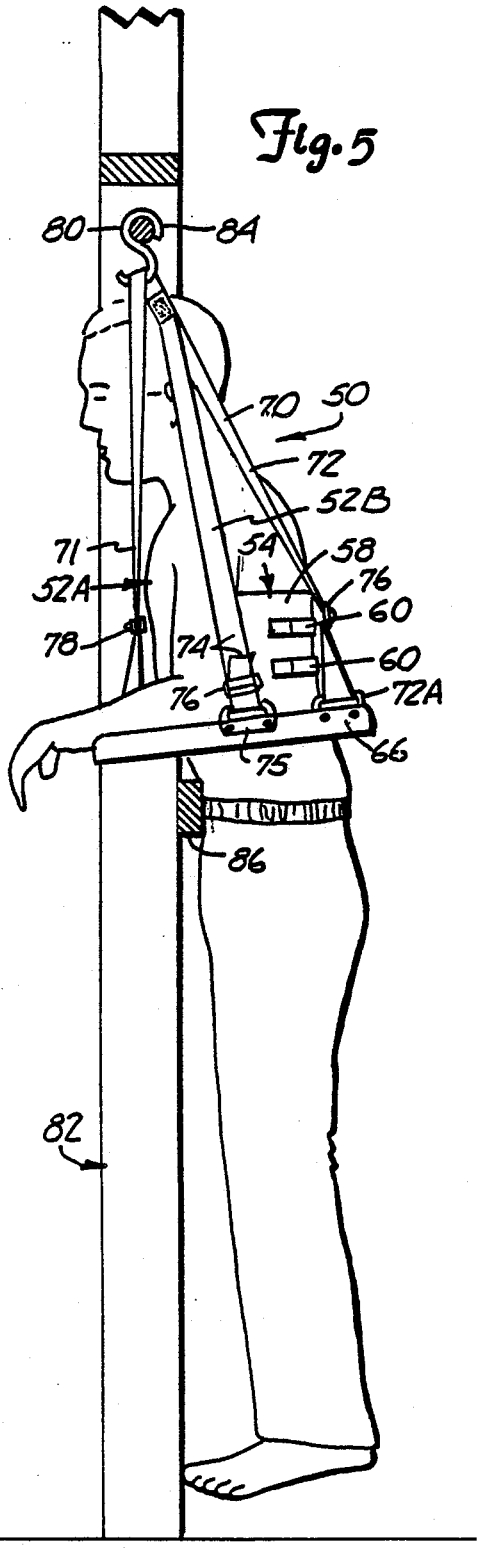
FIG. 5 is a side elevational view with parts of section and parts broken away showing the device in FIG. 4 in a position suspended from a bar and placing the user off center from the normal center of gravity.
Figure 6:
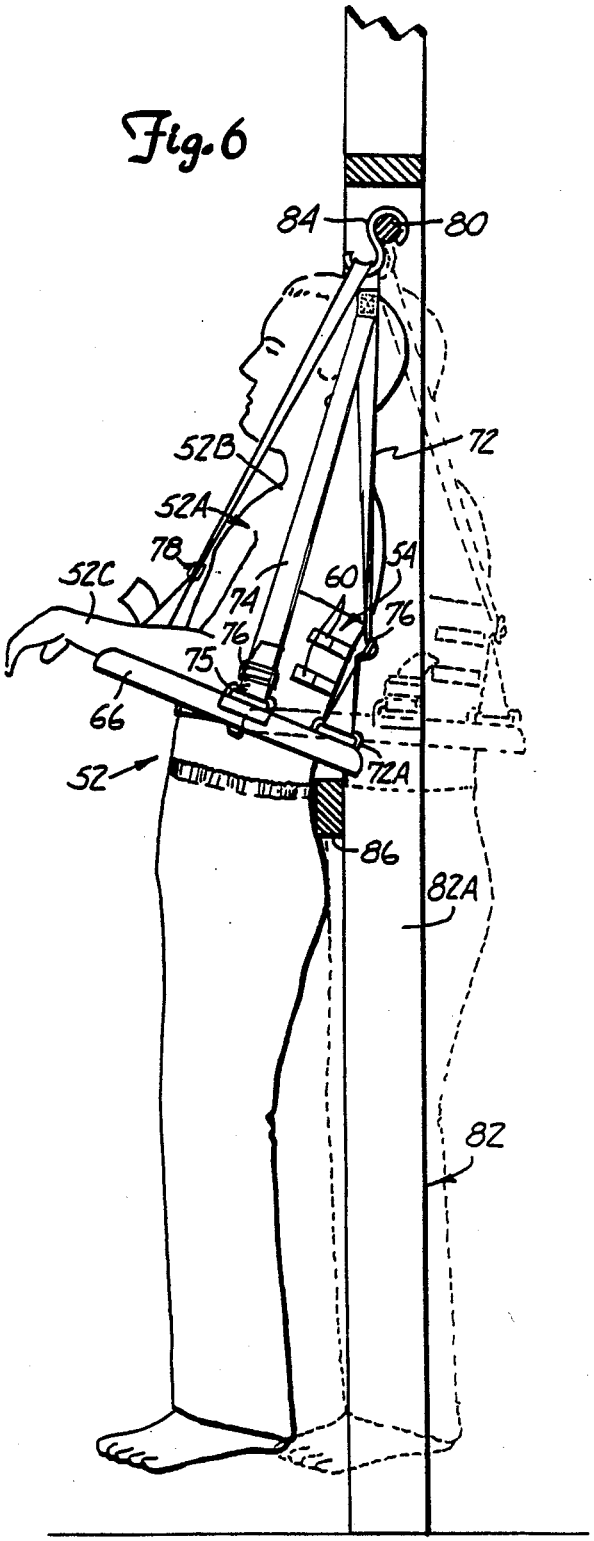
FIG. 6 is a view of a patient suspended in the device of FIG. 4 in a different working position from FIG. 5.
Figure 7:
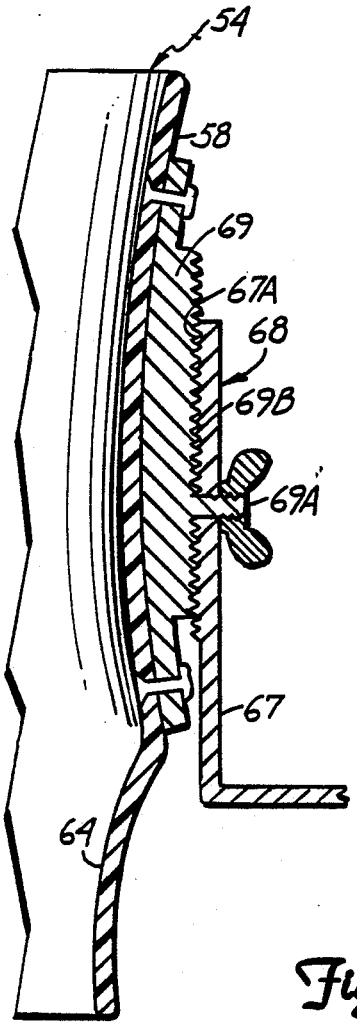
FIG. 7 is a fragmentary vertical sectional view of a bracket for holding a typical arm support used with the device of FIG. 4.

The upright gravity lumbar traction device made according to the second form of the present invention is indicated generally at 50 in FIG. 4 and is shown in FIGS. 5 and 6 being worn by a patient 52 receiving treatment for disorders of the lumbar spine. As perhaps best seen in FIG. 4, the device 50 comprises a hard shelled vest portion 54, which as shown is made into two shell exterior vest sections 56 and 58 that fit around the sides of the body of a wearer or patient near the lower portions of the rib cage. The vest sections 56 and 58 encompass the back and sides of the patient but leave the front open to allow the chest cavity to expand anteriorly for increased comfort and better breathing. The vest portion 54 is made to generally follow the contour of the patient's thorax 52A, and friction between the inner surface of shell portion 54 and the patient's skin will provide additional support and prevent the patient 52 from slipping down during treatment. Also, the unlined surface remains comfortable, but if desired, a thin lining may be added.

Figure 8:
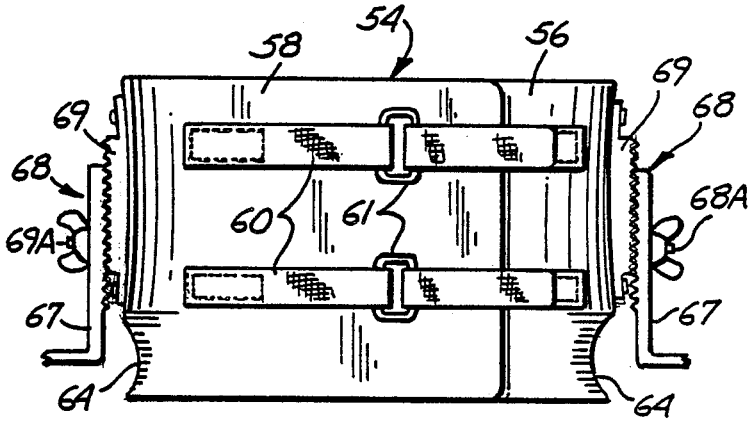
FIG. 8 is a rear view of the device of FIG. 4.

The two vest shell sections 56 and 58 can be adjustably connected at the rear, as shown in FIG. 8, by adjustable suitable connecting means shown at 60, such a pair of adjustable two piece straps each having its end fixed to the respective vest shell section and held together with a divided ring or buckle. Hook and loop fasteners sold under the trademark Velcro may be used for adjusting the length of one or both straps if desired. The mating strap sections are looped through the buckle and folded back on the enclosures and held with the Velcro fasteners. Adjusting the straps 60 will increase or decrease the size of the vest portion 54 to accomodate different size thoraxes of different patients.

The shell sections 56 and 58 may be made of a molded inflexible or rigid plastic, such as polypropylene and may be lined with a suitable thin foam liner 62, as stated, which has suitable frictional properties so that the patient 52 does not slip downward during treatment. The vest portion 50 further supports the patient 52 by having small inwardly protruding ridges as shown at 64 which are located at the sides of the lower edge part of each of the shell sections 56 and 58 to provide support just below the user's rib cage.

Arm supports or arm rests 66 are attached to the sides of each of the vest sections 56 and 58 by an adjustable connector assembly 68 which allows vertical adjustment of the arm supports for accomodating different size patients. The arm supports 66 comprise generally fore and aft elongated trough shaped members which allow the patient 52 to rest his forearms 52C therein with his elbows bent during treatment. By doing so, the patient 52 may support a portion of his weight through his forearms 52C and shoulders 52B and instead of having the weight supported entirely by the vest portion 54. The trough-shaped members 66 are fixed to a horizontal leg of a first bracket 67 of the adjustable connector 68 which has an upright leg that has serrations or teeth which interfit with teeth on a base bracket 69 of the connector 68. Base bracket 69 is fixed to the side of the respective vest shell 56 and 58. The interfitting teeth, positively position the arm supports 26 and a bolt 69A and wing nut are used to hold the base bracket 69 and first bracket 67 assembled. The upright leg of first bracket 67 has a slot receiving bolt 69A and which permits this adjustment near the center.

Figure 9:
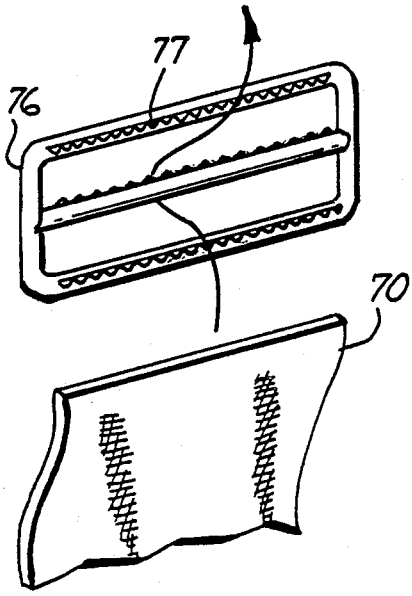
FIG. 9 is an exploded perspective view of a typical non-slip clamp used for retaining the support straps of the present invention to prevent them from slipping once they are positioned.

The vest portion 54 and arm supports or rests 66 are supported by a pair of straps shown generally at 70, which extends above the user. The straps 70 attach to the arm supports 66 and not to the vest portion at all. The straps include front strap portions 71 on which connect to each arm support 66 at a forward end of each respective arm support. The strap portions 71 are thus spaced forwardly of the patient 52 so as not to touch the patient's chest or impede breathing. The strap sections 71 each loop through a respective ring 71A on the respective arm support 66 and the front strap sections 71 are adjustably held by adjustment buckles 76 (formed as shown in FIG. 9) formed to have teeth that prevent the straps from slipping during use. Other standard, non-slip fastener rings or buckles also can be used for buckles 76. Many fastener rings or buckles have a toothed sliding bar on the buckle that slides to tighten on a strap. These non-slip buckles are used on helmets and on various tie-down straps.

Rear strap sections 72 are connected in a like manner to rings 72A, respectively, which are fixed to the rear ends of the arm supports 66 and the rear strap sections are spaced from the back of the patient so as not to pinch the back of the patient during treatment. The strap sections 72 are looped through rings 72A and are adjustably held with non-slip buckles 76 as well. Side strap sections 74 have upper ends fixed (sewed or riveted) near the top of the rear strap sections 72.

The other ends of strap sections 74 are connected to the arm supports 66 respectively at the outer edge and centered on the arm support so as to pull the arm supports 66 upwardly thereby allowing the weight placed on the arm supports to be distributed to the supporting straps rather than back to the sides of the chest, or thorax, which would increase side loading on the chest. The strap sections 74 are looped through rings 75 that are fixed to the outer edges of the arm supports 66. The strap sections 74 are also adjustably held by buckles 76.

The buckles 76 are used for adjusting the straps and have gripping teeth as can be seen typically in FIG. 9 which bear against the respective straps to prevent slippage during treatment and maintain an optimum treatment position.

The front strap sections 71 are held together in front by a quick release connecting latch or hook assembly 78. The latch or hook assembly 78 can be any desired design, but as shown has a strap buckle 78A with a hook on it on one strap section 71 and a strap buckle 78B and a hook receptacle on the other strap section 71. The parts of the latch or hook assembly 78 can be adjusted up or down on the strap sections 71 to change the load angles when supporting a patient. The buckles 78A and 78B used also are non-slip buckles having teeth as shown in FIG. 9. The hook on buckle 78A can be released from the receptacle to allow a patient 52 to quickly get out of the vest during treatment if needed, even under some load. The latch assembly 78 could be a quick release seat belt buckle also. When placing the vest on, the latch assembly 78 is loose or unhooked until the vest is in place and then the latch assembly 78 is hooked up. The rear strap sections 72 also are held together with a fastener system 79 including adjustable, connectable buckles 79A and 79B on the respective strap sections 72. The buckles 79A and 79B comprise center bar buckles that can be adjusted along the strap sections, but which have teeth to positively hold the buckles in position.

A releasable hook system 79C is used to join the buckles or rings 79A and 79B to hold the rear strap sections at a desired angle of support or loading. The hook system 79C does not have to be a quick release system and the buckles 79A and 79B can be fixed together with a permanent cross bar at position 79C.

Sliding the buckles or rings 79A and 79B along strap sections 72 results in changing the loading angle on the arm supports 66 at the rear, and thus changes the loading pressures on the vest portion 54 to insure comfort and adequate support. The vertical position of the fastener assemblies 78 and 79 determines the inward loading of the vest sections and also adjusts the fit. By adjusting the position of the fastener assemblies 78 and 79, the loads on the thorax can be varied.

The treatment device may be used in the home by supporting it on a bar 80 supported in a door frame 82 (See FIGS. 5 and 6). The straps 70 are connected to the bar 80 by "S" hooks 84 that hook onto the straps 70 and over the bar 80. During treatment, if desired, a board or cross bar 86 may be placed between the patient 52 and the spaced vertical side member 82A of the door frame 82. The board 86 is long enough to span the door frame and may be placed in the front or the back of the patient 52 and against the door frame 82 depending on the loading angle desired. This support arrangement changes the support angle to aid in treatment, depending on the disorder being treated. The change in support angle can be adjusted with different size bar and different offsets. The board or bar 86 may also be moved up or down from the positions shown to further increase or decrease the angle at which the patient is supported relative to vertical.

Of course, the board also can be removed to permit the patient to be supported vertically. When supported in a door frame 82, the patient 52 should be at a height which allows the toes to touch the floor so that weight is not necessarily continuously supported by the vest portion 54 or through the arms and shoulders. This allows the patient 52 to receive intermittent treatment (by putting the toes on the floor to support some weight) which may be preferred and also allows the patient to get into and out of the vest portion without aid from others. Weights as shown in the first form of the invention may also be placed around the patient's ankles to increase the traction force during treatment as shown in the first form of the invention.

The patient controls loads through the arm supports or arm rests 66 as well, and can regulate loads for comfort and for breathing ease. The vest portion shown in FIGS. 4, 5, and 6 does not load in a manner that pinches or constricts the chest. The molded roll or ridge at the bottom edge of the vest sections also aids in comfortable support.

The ability to support the body through the forearms, and the ability to support the body on the toes permits the patient to actually lift the body from the vest to permit a "breather" and to allow for full chest expansion whenever desired. By suspending the patient so that only the toes reach the ground, merely lifting the toes will initiate traction. Thus, the knees and hips do not need to be flexed for floor clearance and therefore the suspension allows better relaxation of the leg and trunk muscles. The patient's weight is relieved by lowering the toes. Safety devices to provide for release of the supports can be provided to release the patient if the patient falls asleep, develops a cramp or if other emergencies arise.

The rigid shell vest provides firm support of the body parts at the sides and back rather than circumferential compression of the chest as with prior art cloth vests.

Although the present invention has been described with reference to preferred embodiments, workers skilled in the art will recognize that changes may be made in form and detail without departing from the spirit and scope of the invention.

What is claimed is:

1. A gravity lumbar traction device including a vest for supporting a user, which vest engages the thorax of the user for supporting the user, a pair of arm supports supported on the vest in position for a user to partially support weight on forearms supported on the arm supports, and a plurality of straps adapted to be supported at an external support and attached to the vest through the arm supports only and arranged such that at least one strap supports edges of each of the arm supports spaced from the user to react loads on the vest caused by supporting a user in direction to tend to prevent lower edges of the vest from pressing inward against the user when the user is supported.

2. The device as claimed in claim 1 wherein the straps include spaced front straps on each arm support and means to connect the front straps across an anterior portion of the user's thorax and spaced back straps on each arm support, and means to connect the back straps across the posterior portion of the user's thorax at an angle selected to distribute supporting loads to the vest and the user in a desired manner.

3. The device of claim 2 and manual release means for connecting the front straps to permit release to allow the user to remove the vest while supported.

4. The device of claim 2 wherein the means to connect the back straps comprise adjustable means for connecting the back straps to adjust the selected angle of the back straps to distribute supporting loads reacted to the vest and user in a desired manner.

5. The device as claimed in claim 1 wherein the straps include front and rear support straps, the arm supports being elongated from front to rear and having front and rear ends, the front and rear straps being attached to front and rear ends of the arm supports, thus keeping the front and rear straps away from the user to avoid constricting breathing.

6. The device as specified in claim 1 wherein the vest comprises a shell extending around side and back portions of the thorax only of the user.

7. The device as specified in claim 6 wherein the shell is made into two separate shell sections, and means for holding the two shell sections together.

8. The device of claim 1 wherein the arm support comprise elongated fore and aft extending troughs adjustably fixed to the vest at the sides of the user.

9. The device as specified in claim 8 and means to position the elongated troughs to support the forearms of the user when the elbows of the user are bent.

10. The device as specified in claim 1 wherein the vest is formed in two sections which are spaced apart at a forward side thereof to leave anterior sides of a thorax of a user free to move.

11. The device as specified in claim 10 and means for vertically adjustably mounting the arm supports with respect to the vest.

12. The device as specified in claim 1 wherein the straps are adapted to be supported in a door frame having side members, and a bar of length to span the door frame side members positioned to engage a user supported in the device at the door frame and move the users body out of a normal free suspended position to vary hanging angles of the device and the supported user.

13. The device as specified in claim 7 wherein the two shell sections overlap at the back of the user and are spaced apart at the front of the user.

14. The device as specified in claim 7 wherein the shell sections are adjustably connected to vary the width of the interior of the vest structure.

15. The device as specified in claim 1 wherein the vest is made of a vacuum molded polypropylene to generally follow the contour of the thorax.

16. A gravity lumbar traction device for a user having a thorax, shoulders and arms, the device comprising:

a vest portion capable of supporting weight of the user when worn on the thorax of such user and made of material that is semi-rigid;

arm support means for carrying weight of a user and supported on the vest portion and positioned so that the user is able to place forearms thereon for supporting at least a portion of the user's weight on the arm support means through the shoulders and arms;

strap means mounted with respect to the vest portion for supporting the gravity lumbar traction device from an external support above the user to support the weight of the user under gravity, said strap means comprising a plurality of strap sections adjustably attached to the arm support means, including front strap sections and rear strap sections; and means coupled to the front strap sections to vary the angle of the front strap sections at the front of the user relative to the arm support means, thereby permitting changing the load angle on the vest portion connected to the arm support means.

* * * * *

UNITED STATES PATENT AND TRADEMARK OFFICE

CERTIFICATE OF CORRECTION

PATENT NO. : 4,896,659

DATED : January 30, 1990

INVENTOR(S) : Gary D. Goldish

It is certified that error appears in the above-identified patent and that said Letters Patent is hereby corrected as shown below:

ON TITLE PAGE:

In the References Cited Section, under OTHER PUBLICATIONS, add the following:

Braces Today, Newsletter of the Pope Foundation, Inc., October 1957, page 1, copy in Class 128/75.

Column 8, line 48, delete "back" and insert --rear--.

Signed and Sealed this

Fourteenth Day of January, 1992

*Attest:*

HARRY F. MANBECK, JR.

*Attesting Officer*

*Commissioner of Patents and Trademarks*